US007818848B2

(12) United States Patent
Maerz

(10) Patent No.: US 7,818,848 B2
(45) Date of Patent: Oct. 26, 2010

(54) SAW-TOOTH CLOTHING FOR ROLLERS AND/OR CYLINDERS OF FLAT CARDS OR ROLLER CARDS

(75) Inventor: Juergen Maerz, Duesseldorf (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 147 days.

(21) Appl. No.: 12/327,181

(22) Filed: Dec. 3, 2008

(65) Prior Publication Data

US 2009/0158558 A1 Jun. 25, 2009

(30) Foreign Application Priority Data

Dec. 21, 2007 (DE) ..... 10 2007 062 841

(51) Int. Cl.
*D01G 15/84* (2006.01)

(52) U.S. Cl. ..... 19/114

(58) Field of Classification Search ..... 19/114; D15/78

See application file for complete search history.

(56) References Cited

U.S. PATENT DOCUMENTS 3,605,197 A 9/1971 Watanabe et al.
5,581,848 A * 12/1996 Egerer ..... 19/114
6,408,487 B1 * 6/2002 Atkinson ..... 19/114
6,523,226 B2 * 2/2003 Graf ..... 19/114
6,874,203 B2 * 4/2005 Bauersachs ..... 19/114

FOREIGN PATENT DOCUMENTS

DE 10 2006 015 278 A1 10/2007
EP 1657328 5/2006
GB 1 231 038 A 5/1971

OTHER PUBLICATIONS

Search Report for Application No. GB0822954.4 dated Apr. 16, 2009.
German Search Report dated Jan. 8, 2010, and an English Language translation, issued in related German Patent Application No. 10 2007 062 841.4.

* cited by examiner

*Primary Examiner*—Shaun R Hurley
(74) *Attorney, Agent, or Firm*—Venable LLP; Robert Kinberg

(57) ABSTRACT

A saw-tooth clothing for rollers and/or cylinders of flat cards or roller cards has a foot region and an adjoining tooth region (blade) in which teeth have been formed by cutting, with a tooth front a tooth back and two side flanks, wherein between the tooth back and the tooth front of two adjacent teeth there is a gullet and the teeth consist of at least two portions, with a first portion, forming a technologically effective region. In order to provide a clothing that retains a high level of aggressiveness over its lifetime, the first portion of the tooth front is convex or approximately convex in the direction of movement of the clothing.

10 Claims, 2 Drawing Sheets

SAW-TOOTH CLOTHING FOR ROLLERS AND/OR CYLINDERS OF FLAT CARDS OR ROLLER CARDS

CROSS REFERENCE TO RELATED APPLICATION

This application claims priority from German Patent Application No. 10 2007 062 841.4 dated Dec. 21, 2007, the entire disclosure of which is incorporated herein by reference.

BACKGROUND OF THE INVENTION

The invention relates to a saw-tooth clothing for rollers and/or cylinders of flat cards or roller cards, having an elongate foot region (foot) and an adjoining tooth region (blade) in which teeth have been formed by cutting, which teeth have a tooth front, a tooth back and two side flanks, wherein between the tooth back and the tooth front of two teeth arranged one after the other there is a gullet. In a known clothing, the teeth have first and second portions, with a first portion, located at a tooth tip, having a positive or at least vertical working angle (face angle) and the portion between the tooth tip and the transition region between the first and the second portion forming a technologically effective region.

The cylinder clothing of a flat card or roller card becomes worn down by the production process. The originally sharp tip becomes rounded off and a portion of the front side of the tooth is worn away. The wear on the tooth front becomes increasingly great towards the top in the direction towards the tooth tip, so that the angle of the front side of the tooth with respect to the vertical (front angle) become ever smaller. It is attempted to restore the original aggressiveness of the clothing by resharpening the clothing. As a result, at best only the tip of the clothing becomes sharp again. The reduced size of the front angle and the rounded tooth flanks remain and lead to a progressive loss of aggressiveness, resulting in a decline in the quality of the fibre material produced.

In the case of a known clothing (EP 1 657 328 A2), the first region of the tooth front is in the form of a straight line. After resharpening, the teeth exhibit a considerable loss of aggressiveness.

BACKGROUND OF THE INVENTION

It is an aim of the invention to provide a saw-tooth clothing of the kind described at the beginning which avoids or mitigates the mentioned disadvantages and which, especially, retains a high level of aggressiveness over its lifetime.

The invention provides a saw-tooth clothing for rollers of flat cards or roller cards, having an elongate foot region and an adjoining blade in which teeth have been formed by cutting, which teeth have a tooth front, a tooth back and two side flanks, wherein the tooth front has a first portion extending from the tooth tip and a second portion extending from said first portion towards the foot region and the first portion of the tooth front is substantially convex.

The first portion of the tooth front is substantially convex in the direction towards the tooth back of the adjacent tooth (that is, the tooth back on the opposite side of the adjacent gullet). In practice, therefore, the first portion of the tooth front is preferably convex, or approximately convex, in the direction of movement of the clothing.

Because the first portion of the tooth front is convex in the direction of movement of the clothing, the wear-induced reduction in the front angle may be lessened or the front angle may remain the same or even be enlarged. As a result, the loss of aggressiveness caused by the non-resharpenable rounded-off tooth flanks and by the wear-induced reduction in the front angle $\alpha$ can be mitigated or compensated for. The quality of the product produced is accordingly subject to less fluctuation.

In practice that is achievable as a result of the resharpening of the tooth that is customary for cylinder and roller card clothings. In that procedure, the tooth tip is ground from the top until a sharp working edge is formed again at the tip. The reduction in height that occurs each time the clothing is ground causes the resulting tooth tip on the tooth front to migrate a little further downwards each time. In the case of the invention, because of the special shape of the tooth, that results in principle in an increase in the front angle. The wear-induced reduction in the face angle customary in cylinder and roller card clothings is thus lessened or does not occur.

Advantageously, the second portion of the tooth front is concavely or approximately concavely curved in the direction of movement of the clothing.

In certain preferred embodiments, the first portion is arcuately curved. Advantageously, the first portion merges into the second portion.

In use of the clothing of the invention, the wear-induced reduction in the working angle (front angle) is lessened. In certain embodiments, the working angle (front angle) remains the same on wear. In other embodiments, the working angle (front angle) becomes greater on wear. Preferably, the reduction or enlargement or retention of the working angle (front angle) is effected after resharpening of the clothing. Preferably, the clothing is an all-steel clothing.

The invention further provides a flat card or roller card, comprising a roller and/or cylinder on which is mounted a saw-tooth clothing constructed in accordance with the invention.

The invention also provides a saw-tooth all-steel clothing for rollers and/or cylinders of flat cards or roller cards, having an elongate foot region (foot) and an adjoining tooth region (blade) in which teeth have been formed by cutting, which teeth have a tooth front, a tooth back and two side flanks, wherein between the tooth back and the tooth front of two teeth arranged one after the other there is a gullet and the teeth consist of at least two portions, with a first portion, located at a tooth tip, having a positive or at least perpendicular working angle (front angle) and the spacing between the tooth tip and the transition region between the first and the second portions forming a technologically effective region, wherein the first portion of the tooth front is convex or approximately convex in the direction of movement of the clothing.

DETAILED DESCRIPTION OF A PREFERRED EMBODIMENT

Figure 1A:
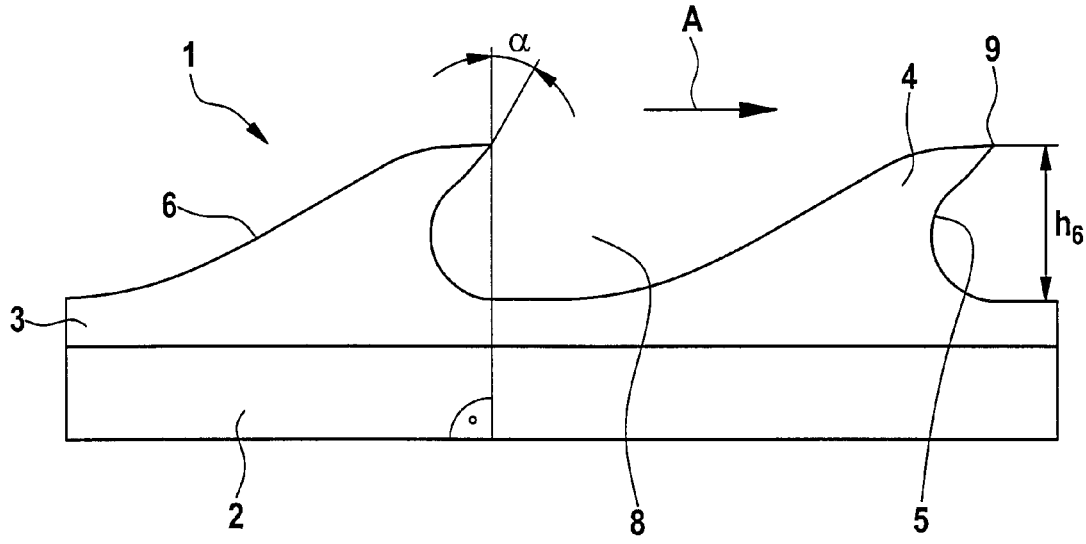
FIGS. 1*a,* 1*b* are a diagrammatic side view (FIG. 1*a)* and sectional view (FIG. 1*b*) of the saw-tooth clothing according to the invention.

FIGS. 1*a,* 1*b* show in side view and in section, respectively, one illustrative embodiment of saw-tooth wire 1 according to the invention which consists of an elongate foot region (foot 2) and an adjoining blade region (blade 3) in one piece. Teeth 4 have been formed in the blade 3 by cutting, which teeth have a tooth front 5, a tooth back 6 and two side flanks 7*a,* 7*b* (see FIG. 1*b*). Between the tooth back 6 and the tooth face 5 of two teeth 4 arranged one after the other there is in each case a gullet 8. The teeth 4, i.e. the tooth front 5, consists of two portions, with a first portion $\mathbf{5}_1$ located at a tooth tip 9, having a positive working angle $\alpha$. The working angle $\alpha$ (front angle) is the angle between the tangent to the convexly curved first portion $\mathbf{5}_1$ at the tooth tip 9 and the vertical axis to the base of the wire (lower face of the tooth foot 2). The portion between the tooth tip 9 and the transition region between the first portion $\mathbf{5}_1$ and the second portion $\mathbf{5}_2$ of the tooth face 5 (tooth front) forms a technologically effective region that is, it is effective in use of the clothing. The first portion $\mathbf{5}_1$ of the tooth front 5 is convexly curved in the direction of movement A of the clothing 1. The second portion $\mathbf{5}_2$ of the tooth front is concavely curved.

Figure 1B:
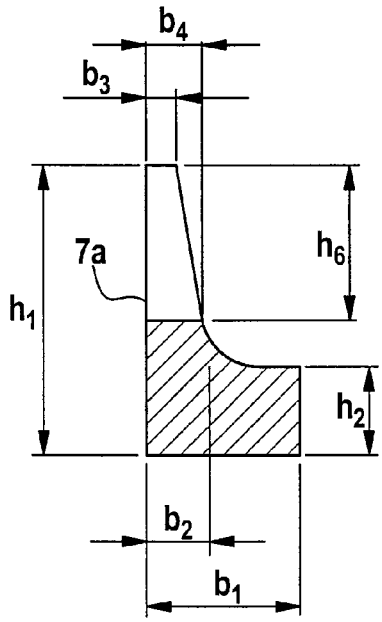

The following are indicated in FIG. 1*b:*

| Symbol | Term | Definition |
|---|---|---|
| $h_1$ | Total height of the wire | Distance from the base to the tip of the wire |
| $h_2$ | Foot height | Height of the foot measured from the base |
| $b_1$ | Foot width | Width of the foot at the base of the wire |
| $b_2$ | Blade width at the foot | Width of the blade, measured at the foot |
| $b_3$ | Blade width at the tip | Width of the blade, measured at the tip |

$H_6$ denotes the blade height which is obtained from the difference $h_1-h_2$. $b_4$ denotes the blade width at the point of the deepest gullet cut-out.

Figure 2A:
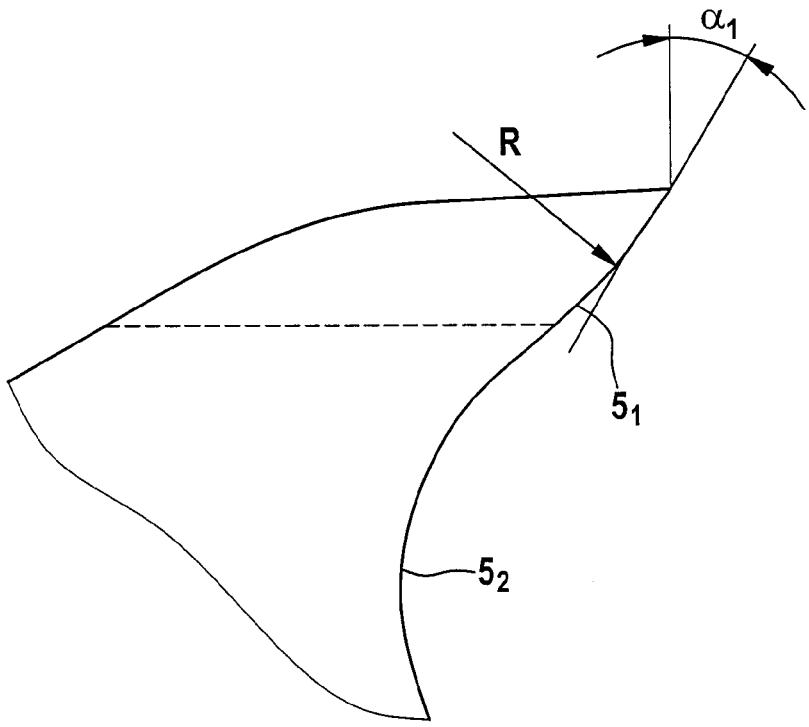
FIG. 2*a* is a partial view of a tooth front showing a first, convexly curved portion and part of a second portion in the as new state.

FIG. 2*a* is a partial view of a tooth front 5 having a first, convexly curved portion $\mathbf{5}_1$ and part of a second portion $\mathbf{5}_2$ in the as new state.

The clothing 1 of the flat card or roller card is subjected to a certain amount of wearing down by the production process. The originally sharp tip 9 (FIG. 1*a*) becomes rounded-off, the tooth flanks 7*a,* 7*b* become rounded and a portion of the front side of the tooth is successively worn away. The wear on the tooth 5 becomes increasingly great towards the top, in the direction towards the tooth tip 9, with the result that the front angle $\alpha$ becomes constantly smaller over the total service life of a clothing 1.

Figure 2B:
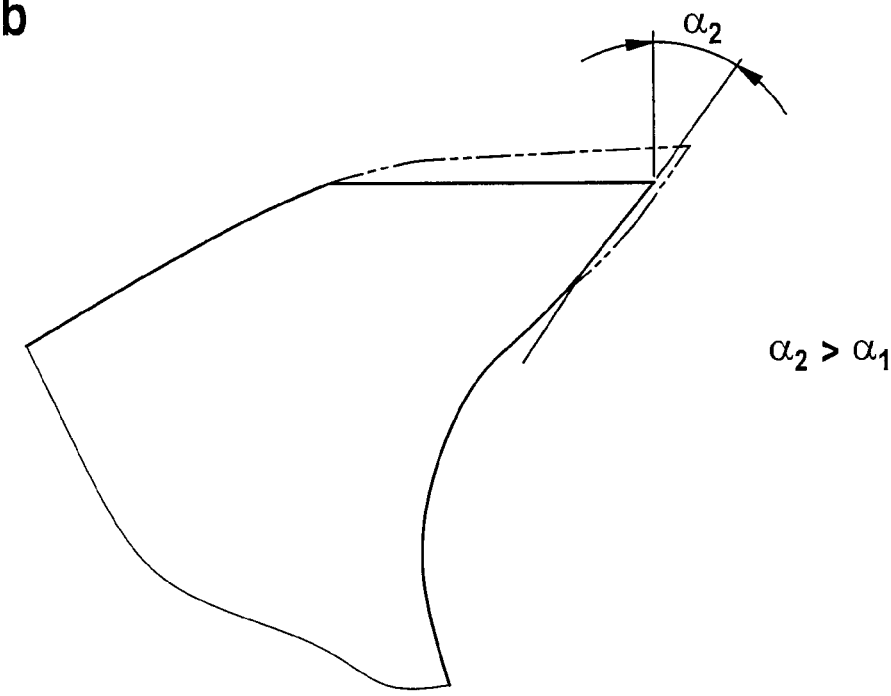
FIG. 2*b* is a partial view of the tooth according to FIG. 2*a* showing a first, convexly curved portion and part of the second portion after resharpening.

By resharpening the clothing 1 according to the invention, the original aggressiveness of the clothing 1 is restored. In FIG. 2*b,* the original contour in accordance with FIG. 2*a* is indicated by a dash-dotted line and the contour of the reground clothing by a solid line. The working angle $\alpha_1$ in accordance with FIG. 2*a* is smaller than the working angle $\alpha_2$ in accordance with FIG. 2*b.*

In FIG. 2*a,* R denotes the radius of curvature of the first portion $\mathbf{5}_1$. Whilst the embodiment shown in FIGS. 1*a,* 1*b,* 2*a* and 2*b* has a convex surface with a constant radius of curvature R, other embodiments may be configured with a surface 5 that does not have a completely uniform radius of curvature provided that the surface $\mathbf{5}_1$ is approximately convex in configuration. Although the foregoing invention has been described in detail by way of illustration and example for purposes of understanding, it will be obvious that changes and modifications may be practised within the scope of the appended claims.

The invention claimed is:

1. A saw-tooth clothing for rollers of flat cards or roller cards, having an elongate foot region and an adjoining blade in which teeth have been formed by cutting, which teeth have a tooth tip comprising a sharp working edge, a tooth front, a tooth back and two side flanks, wherein the tooth front has a first portion extending from the tooth tip and a second portion extending from said first portion towards the foot region and the first portion of the tooth front is substantially convex.

2. A saw-tooth clothing according to claim 1, in which the second portion of the tooth front is substantially concave.

3. A saw-tooth clothing according to claim 1, in which the first portion is arcuate.

4. A saw-tooth clothing according to claim 1, in which the first portion merges into the second portion.

5. A saw-tooth clothing according to claim 1, in which the wear-induced reduction in a working angle defined by the first portion is lessened.

6. A saw-tooth clothing according to claim 1, in which, during operation and subsequent re-grinding, a working angle defined by said first portion remains the same.

7. A saw-tooth clothing according to claim 1, in which, during operation and subsequent re-grinding, a working angle defined by said first portion becomes greater.

8. A saw-tooth clothing according to claim 1, in which a reduction or enlargement or retention of a working angle defined by said first portion is effected after resharpening of the clothing.

9. A saw-tooth clothing according to claim 1, which is an all-steel clothing.

10. A flat card or roller card, comprising a roller or cylinder on which is mounted a saw-tooth clothing in accordance with claim 1.

* * * * *